US005409373A

United States Patent [19]

Phillips et al.

[11] Patent Number: 5,409,373

[45] Date of Patent: Apr. 25, 1995

[54] BURNER HOUSING FOR MULTI OIL FURNACES

[75] Inventors: Frederick W. Phillips; David J. Yoder, both of Leola, Pa.

[73] Assignee: Clean Burn, Inc., Leola, Pa.

[21] Appl. No.: 227,340

[22] Filed: Apr. 14, 1994

[51] Int. Cl.[6] ..... F23D 11/44

[52] U.S. Cl. ..... 431/208; 431/265

[58] Field of Search ..... 431/265, 208

[56] References Cited

U.S. PATENT DOCUMENTS

| | | | |
|---|---|---|---|
| 1,493,820 | 5/1924 | Miller | 431/207 |
| 2,841,215 | 7/1958 | Messer | 431/28 |
| 3,070,151 | 12/1962 | Goossens | 431/28 |
| 3,977,823 | 8/1976 | Bernhard | 431/11 |
| 4,162,887 | 7/1979 | Gray | 431/28 |
| 4,460,328 | 7/1984 | Niederholtmeyer | 431/11 |
| 4,877,395 | 10/1989 | Schubach | 431/28 |
| 5,067,894 | 11/1991 | Bender | 431/208 |

OTHER PUBLICATIONS

Jun., 1990, Reznor Sales brochure for "Waste Oil Heater".

Aug. 25, 1992, Clean Burn Operator's Manual for Models CB-90-AH and CB-90-BH with CB-90-HS Burner.

*Primary Examiner*—Carroll B. Dority

*Attorney, Agent, or Firm*—Larry W. Miller

[57] ABSTRACT

A compartmentalized housing for the operative components of a multi oil furnace is disclosed wherein the first housing compartment contains an integrated preheater block and operative controls for the flow of used oil and compressed air to the burner assembly, which is cantilevered from the preheater block and positioned within the second housing compartment. The second housing compartment rotatably supports a combustion air fan to draw combustion air through an inlet opening in the second housing and blow the combustion air into the burner chamber over the burner assembly, which is configured and oriented to minimize combustion air turbulences. The fan motor is supported within the third housing compartment. Each of the housing compartments is provided with a removable cover to permit access to the respective component housed therein. The removable cover for the second housing compartment mounts the electrical power supply for the flame igniter so that the power to the igniter is disconnected whenever the cover is removed.

16 Claims, 5 Drawing Sheets 12
14b
14a
10
19
62
11
13
81
71
81
45
55
4
30
4
63
82
78
59
48
79
25
26
70
74
77
72
73
29
28
13

BURNER HOUSING FOR MULTI OIL FURNACES

BACKGROUND OF THE INVENTION

This invention relates generally to furnaces for the burning of used oil and, more particularly, to a burner housing for use in conjunction with multi oil furnaces to facilitate service of the operative components of the furnace and for improving the flow of combustion air into the burner chamber for a more efficient burning of different oils, including used oil, therein.

Multi oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature, which requires a preheating of the used oil to more efficiently effect a burning of the used oil products.

The burner nozzle combines a flow of compressed air with the flow of preheated used oil to atomize the used oil and inject a stream of compressed air and atomized used oil droplets into the burner chamber of the used oil furnace where it is ignited to create a heat source. Known multi oil furnace burner nozzles utilize an in-line burner nozzle configuration coupled directly into the preheater block and are mounted to the furnace cabinet door to be positioned within the air flow stream of combustion air created by an external fan.

Furthermore, the required imposition of an igniter mechanism further impedes the air flow of the combustion air into the burner chamber. All of this structure creates turbulences within the air flow stream of combustion air to detract from the efficient operation of the furnace. Typically, air flow stabilizers or structure for redirecting the combustion air flow are required to proper placement and direction of the combustion air.

Service of the operative components of the multi oil furnace can be a significant problem since many of the in-line components of the known multi oil burner assemblies require at least some disassembly before reaching the component to be replaced. Furthermore, the operative controls of known multi oil furnaces have not been positioned or oriented with service foremost in mind. Accordingly, the provision of a compartmentalized burner housing with modular operative components would be desirable to improve service aspects of multi oil furnaces.

Furthermore, it would be desirable to devise a more aerodynamic orientation of the burner assembly and a more efficient flow of combustion air over the burner assembly to the burner chamber such that combustion air turbulences would be minimized and, thereby, increase the burning efficiency of the multi oil furnace.

SUMMARY OF THE INVENTION

It is an object of this invention that a multi oil furnace is provided with a compartmentalized burner housing and modular operative components supported within separate housing compartments.

It is another object of this invention to improve serviceability aspects of multi oil furnaces.

It is still another object of this invention to devise a burner housing to more efficiently direct a flow of combustion air to the burner chamber.

It is an advantage of this invention that combustion air is directed to the burner chamber with a minimum of turbulence.

It is a feature of this invention that the burner assembly is cantilevered from the preheater block and positioned within a separate housing compartment from the compartment in which the preheater block is supported.

It is another advantage of this invention that the need for air flow stabilizers to re-direct combustion air around the burner nozzle and into the burner chamber is eliminated.

It is another feature of this invention that the flow of combustion air is restricted within a housing compartment in which is supported the combustion air fan and the burner assembly.

It is still another advantage of this invention that the serviceability of multi oil furnaces is improved.

It is still another feature of this invention that the power supply for the electrodes igniting the stream of compressed air and atomized used oil droplets discharged from the burner nozzle is mounted on the removable cover for the housing compartment in which the burner assembly is supported.

It is yet another advantage of this invention that the movement of the housing cover to gain access to the burner assembly effects a disconnection of the power supply to the igniter electrodes.

It is yet another feature of this invention that the housing is configured in such a manner as to direct the combustion air linearly generally parallel to the longitudinal axis of the burner nozzle.

It is yet another feature of this invention that the burner assembly is more aerodynamically configured to minimize turbulences within the flow of combustion air over the burner assembly.

It is a further advantage of this invention that the minimizing of the air turbulences in the flow of combustion air increases the burning efficiency of the furnace.

It is yet a further object of this invention to provide a burner housing for a multi oil furnace which is durable in construction, inexpensive of manufacture, carefree of maintenance, facile in assemblage, and simple and effective in use.

These and other objects, features, and advantages are accomplished according to the instant invention by providing a compartmentalized housing for the operative components of a multi oil furnace is disclosed wherein the first housing compartment contains an integrated preheater block and operative controls for the flow of used oil and compressed air to the burner assembly, which is cantilevered from the preheater block and positioned within the second housing compartment. The second housing compartment rotatably supports a combustion air fan to draw combustion air through an inlet opening in the second housing and blow the combustion air into the burner chamber over the burner assembly, which is configured and oriented to minimize combustion air turbulences. The fan motor is supported within the third housing compartment. Each of the housing compartments is provided with a removable cover to permit access to the respective component housed therein. The removable cover for the second housing compartment mounts the electrical power supply for the flame igniter so that the power to the igniter is disconnected whenever the cover is removed.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
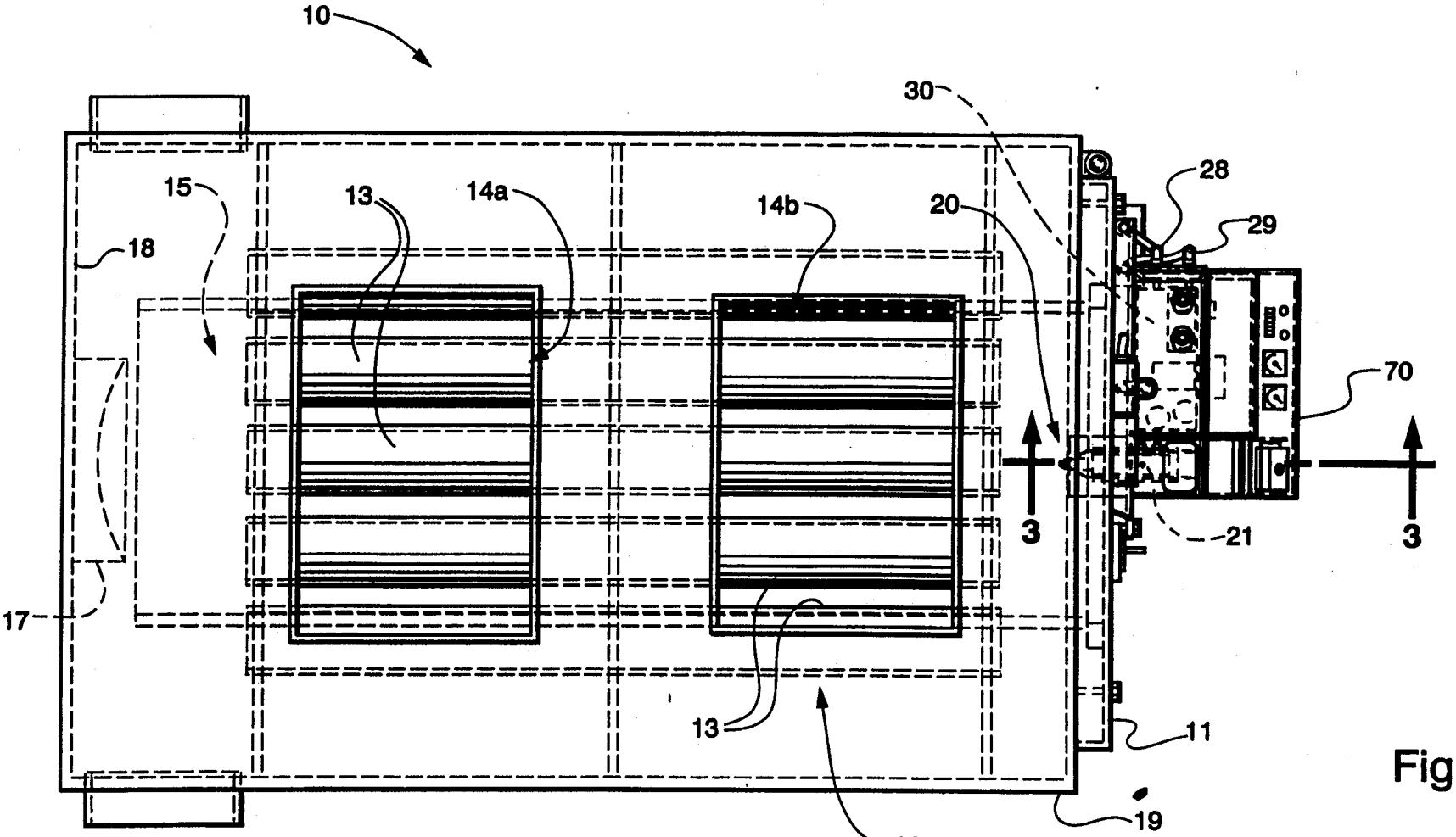
FIG. 1 is a top plan view of a multi oil furnace incorporating the principles of the instant invention.
Figure 2:
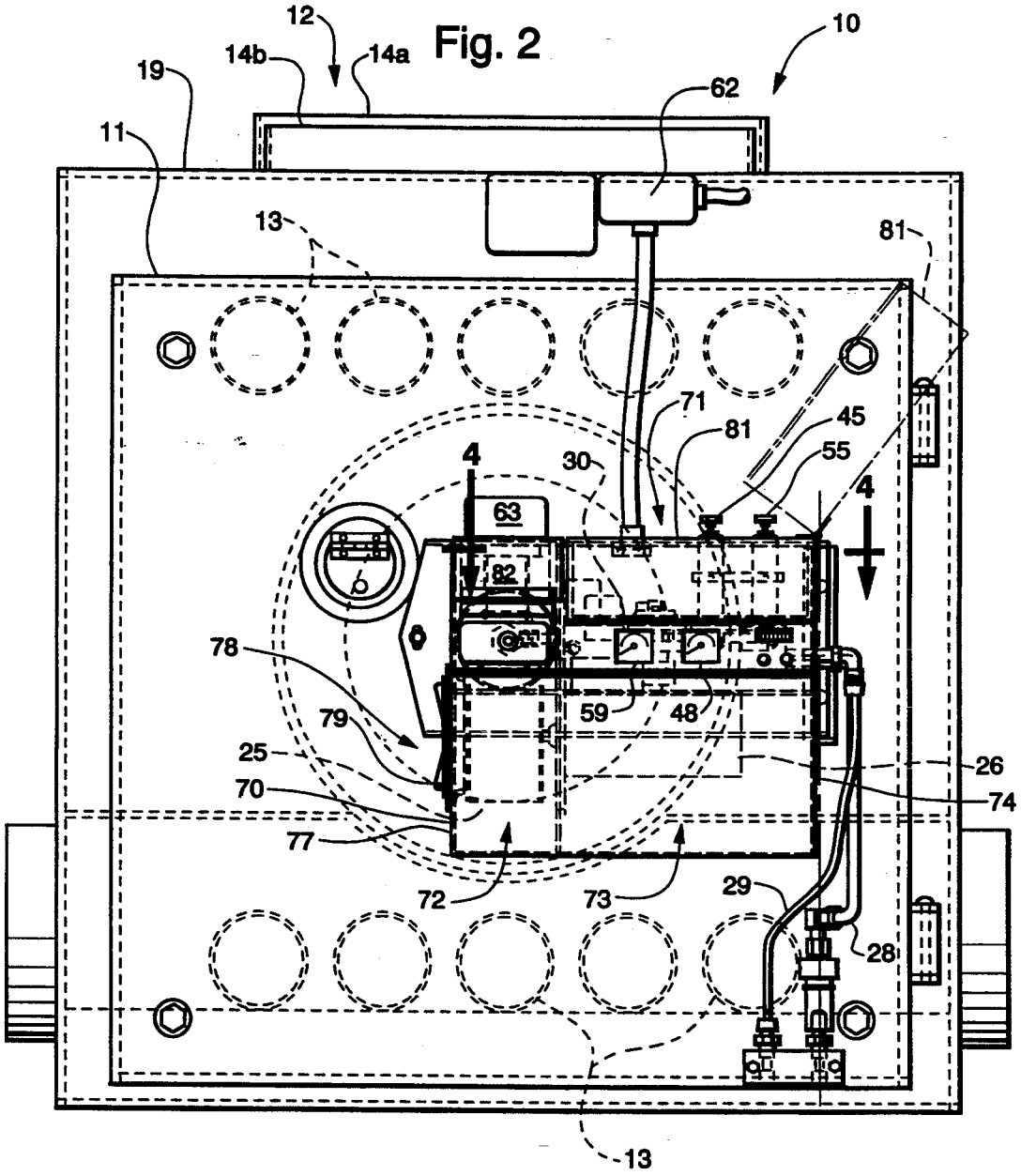
FIG. 2 is a front elevational view of the multi oil furnace shown in FIG. 1, the removable cover for the first housing compartment being depicted in the raised position in phantom.

Referring now to FIG. 1, a top plan view of a multi oil furnace incorporating the principles of the instant invention can best be seen. The furnace 10 includes a cabinet shell 19 enveloping a heat exchanger 12 and a central burner chamber 15. A burner assembly 20 is mounted on the front door 11 to fire a flame into the burner chamber 15 toward a target 17 mounted on the back wall 18 of the burner chamber 15. The heat exchanger 12 allows the circulation of clean air to be heated around pipes 13 carrying heated combustion gases before being discharged from the furnace 12. The furnace 12 incorporates a clean air inlet opening **14*a* and a clean air exit opening 14*b* to provide for the passage of the clean air to be heated within the heat exchanger 12**.

Figure 3:
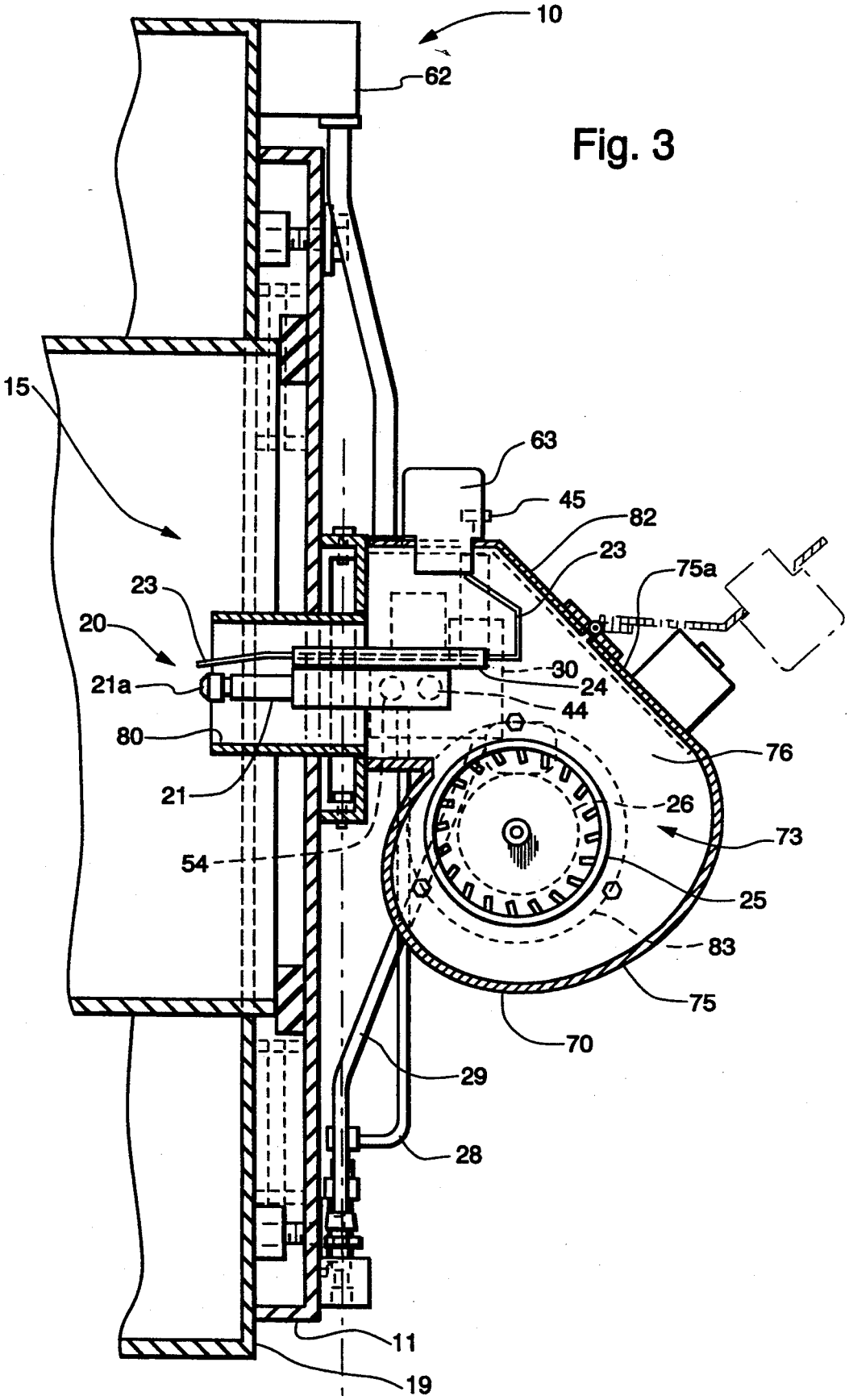
FIG. 3 is an enlarged cross-sectional view of the multi oil furnace taken along lines 3—3 of FIG. 1 to better show the burner assembly.
Figure 4:
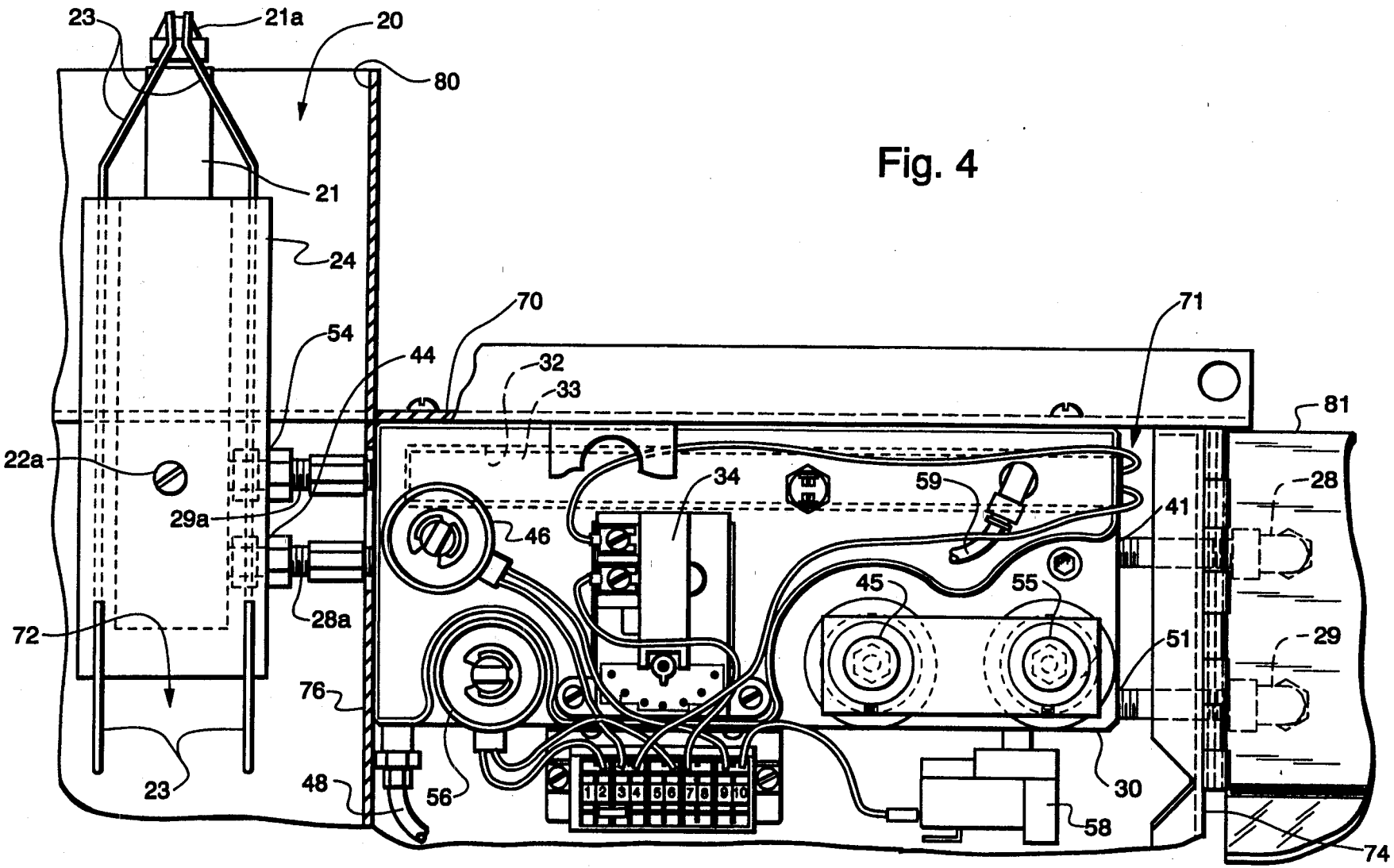
FIG. 4 is an enlarged partial cross-sectional view of the burner assembly taken along lines 4—4 of FIG. 2 to depict a top view of the preheater block.

Referring now to the views of FIGS. 3 and 4, the details of the burner assembly 20 and the preheater block 30 can best be seen. The burner assembly 20 includes a burner nozzle 21 and an igniter 22 to create a flame from the used oil supplied thereto as defined in greater detail below. The preheater block 30 mounts various controls for the flow of used oil and compressed air to the burner nozzle 21, as will also be described in greater detail below.

The preheater block 30 defines two separate flow paths for used oil and compressed air, respectively. The preheater block 30 is formed with a heater chamber 32 in which is housed a heating element 33, electrically coupled to a preheater thermostat 34 and a power supply 62. The heating element 33 is removably mounted within the heater chamber 32 and provides a source of heat when electrical current is passed through the heating element 33. The preheater block 30 is formed of metallic material, such as aluminum, and is, therefore, conductive of the heat generated by the heating element 33.

The flow of used oil is introduced into the preheater block 30 from the line 28 delivering unheated used oil from an external tank (not shown) to the inlet port 41. The flow path for the used oil through the preheater block 30 makes approximately seven passes through the block 30 before exiting the outlet port 44 to absorb conductive heat to enable the delivery of used oil preheated to a predetermined temperature to the burner assembly 20.

An oil flow regulator 45 is manually operable to control the rate of flow of used oil through the block 30 and, therefore, to the burner assembly 20. A solenoid shut-off mechanism 46 is coupled to the oil flow path immediately adjacent the oil outlet port 44 to minimize the amount of used oil that can drip through the burner nozzle 21. An oil pressure gauge 48 is tapped into the oil flow path down stream from the solenoid shut-off 46 to register the flow of used oil to the burner nozzle 21.

The flow of compressed air is introduced into the preheater block 30 through the air inlet port 51 from a connecting line 29 couple to a conventional source of compressed air (not shown). The flow path for the compressed air through the preheater block 30 makes approximately three passes through the block 30 to absorb sufficient conductive heat from the block 30 to raise the temperature to approximately the same level as the used oil before exiting the outlet port 54 for delivery of preheated compressed air to the burner assembly 20. An air flow regulator 55 is manually operable to control the flow of compressed air through the block 30 and, therefore, to the burner assembly 20.

A solenoid shut-off mechanism 56 is operable to halt the flow of compressed air through the system. An air pressure gauge 59 is tapped into the compressed air flow path down stream from the solenoid shut-off 56 to register the flow of compressed air to the burner nozzle 21. An air sensing switch 58 detects the presence of compressed air flowing to the burner nozzle 21 and is operable to prevent the oil solenoid shut-off 46 from opening whenever compressed air is not present in the system.

As is best seen in FIGS. 1–4, the burner housing 70 is divided into three compartments 71, 72 and 73, respectively, to improve serviceability of the controls and operative components of the furnace 10. The preheater block 30 and associated operative controls are supported in the first housing compartment 71. The used oil connecting line 28 and the compressed air connecting line 29 pass through corresponding openings in the right side wall 74 to connect with the respective inlet ports 41, 51 of the preheater block 30. Similarly, the interior wall 76 separating the first and second housing compartments 71, 72 is provided with appropriate openings for the passage of the connecting lines **28*a*, 29*a* for the supply of preheated used oil and compressed air, respectively, to the burner nozzle 21**.

The burner assembly 20 is supported from the preheater block 30 in a cantilever fashion by the connecting lines **28*a*, 29*a* supplying preheated used oil and compressed air to the burner nozzle 21 and is positioned within the second housing compartment 72, separated from the first housing compartment 71 by the interior wall 76. The function of the nozzle 21 is to combine the flows of compressed air and used oil from the preheater block 30 to create a stream of compressed air and atomized used oil droplets to be ejected from the nozzle 21 into the burner chamber 15. The igniter 22 is detachably mounted to the burner nozzle 21 by the fastener 22*a* to locate the igniter electrodes 23 in the proper position relative to the nozzle 21** for ignition of the stream of compressed air and atomized used oil droplets.

A fan 25 for supplying quantities of combustion air into the burner chamber 15 is rotatably mounted in the second housing compartment 72 below the burner assembly 20. The rotatable fan 25 draws combustion air from the atmosphere around the furnace 10 through an air inlet opening 78 in the left side wall 77. Adjustment louvers 79 are movable relative to the left side wall 77 to control the effective size of the air inlet opening 78 and, thereby, control the volume of combustion air being blown into the burner chamber 15.

As best seen in FIG. 3, the second compartment 72 of the housing 70 incorporates a curved outer peripheral surface 75 formed in somewhat of a spiral shape to direct, in conjunction with the linear deflector portion 75*a* of the outer periphery of the second housing compartment 72, the flow of combustion air from the fan 25 into a linear flow path through the discharge opening 80 in the second compartment 71 leading to the burner chamber 15. The burner assembly 20 has a longitudinal major axis which is oriented parallel to and within the linear flow path of the combustion air being blown into the burner chamber 15 by the fan 25.

It has been found that the combination of the spiraled curved portion 75 and the linear deflector portion 75*a* forming the outer periphery of the second housing compartment 72 directs a flow path of combustion air with very little turbulence. The small perpendicular profile of the burner assembly 20 further minimizes combustion air turbulence. The motor 26 for driving the rotation of the combustion air fan 25 is mounted in the third housing compartment 73, which is also separated from the second compartment 72 by the interior wall 76. As a result, the flow of combustion air is contained within the second housing compartment 72. The lack of turbulence eliminates the need for typical air flow stabilizers or other air directing structures around the burner assembly 20.

Each of the housing compartments 71, 72 and 73, is provided with its own removable cover 81, 82 and 83, respectively. The first compartment cover 81 is hinged to the right side wall 74 and opens to expose the entire preheater block 30 and attached components for servicing, testing, etc. The first compartment cover 81 has a pair of apertures through the top surface to expose the oil and air regulators 45, 55 for manual manipulation without requiring the cover 81 to be opened. The third compartment cover 83 is simply attached to the right side wall 74 to cover an access opening therein to allow access to the fan motor 26.

The second compartment cover 82 is hinged to and forms a portion of the linear deflector portion 75*a* of the outer peripheral portion of the second compartment 72. A power transformer 63, which receives electrical power from the primary source of electrical power 62, is mounted on the second compartment cover 82 and operatively extends into the second housing compartment 72. The electrodes 23 of the igniter 22 extend upwardly from the insulator block 24 to contact the power transformer 63 and receive electrical current therefrom to ignite the stream of compressed air and used oil droplets ejected from the burner nozzle 21 by creating a spark in a conventional manner.

Whenever the second compartment cover 82 is lifted to provide access to the burner assembly 20 for service thereof, the transformer 63 is disconnected from the electrodes 23, but also has contact broken with the primary power source 62. One skilled in the art will readily realize that once the flame has started, the continuous ejection of the stream of compressed air and atomized used oil droplets will be self-igniting and does not require the use of the power transformer 63 to continue operation of the furnace 10. Regular maintenance of the burner assembly 20 includes an annual replacement of the igniter 22. One skilled in the art will readily recognize that access to the igniter 22 and inspection of both the burner assembly 20 and the combustion air fan 25 is conveniently available through the second compartment cover 82.

By use of the compartmentalized burner housing 70, access to the preheater block 30 and associated components and to the combustion air fan motor 26 can be attained without disrupting the flow of combustion air within the second housing compartment 72 over the burner assembly 20 to the burner chamber 15. Furthermore, the separation of the operative components from the combustion air flow minimizes the exposure of these components to the dust and dirt that is associated with the supply of combustion air and to the oxidizing effects of the proximate open flame. The operative gauges, such as the oil pressure gauge 48 and the air pressure gauge 59, can be mounted to the exterior of the housing 70 for readability without moving a compartment cover 81–83.

Figure 5:
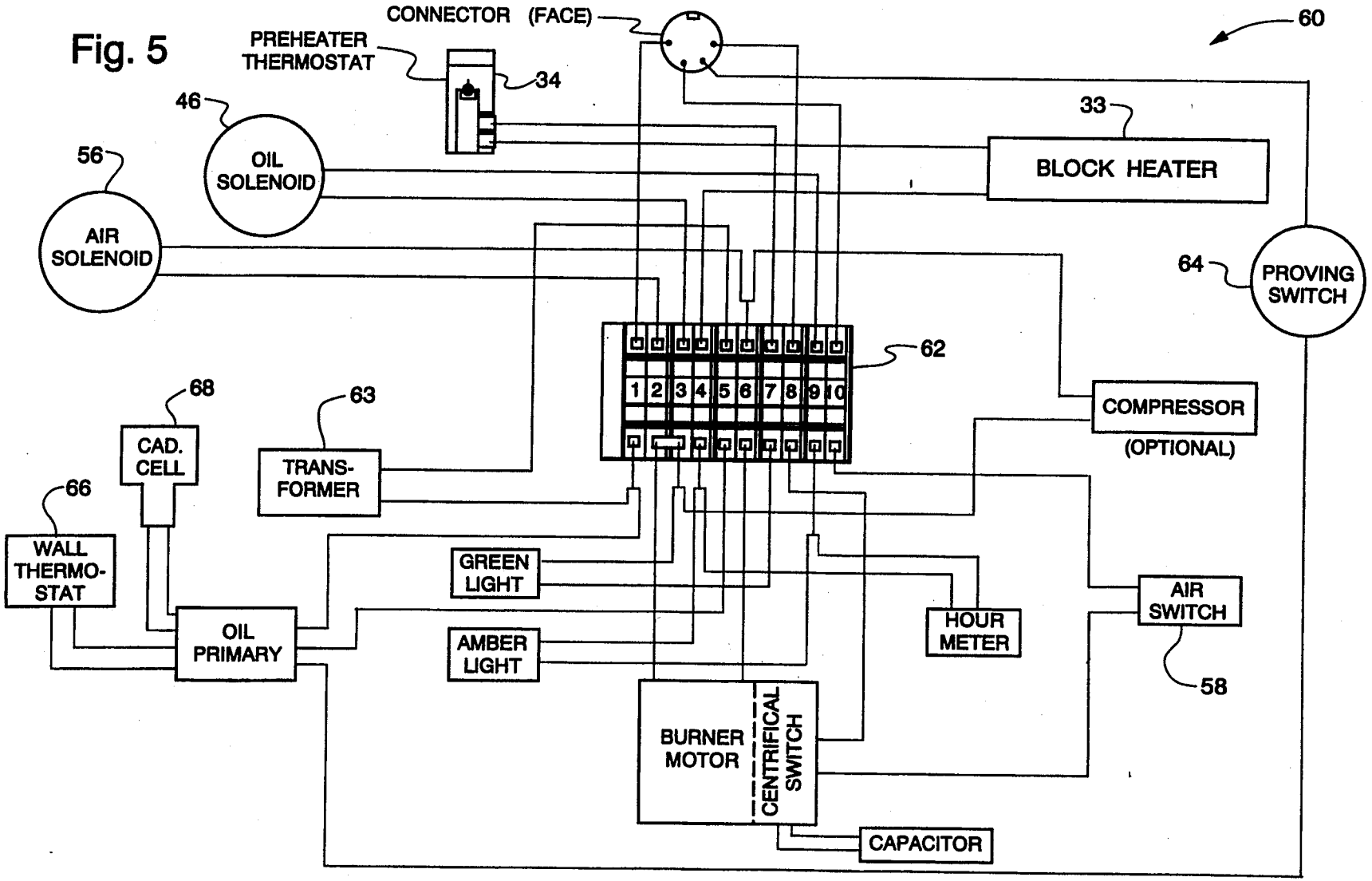
FIG. 5 is a schematic wiring diagram of the electrical circuit for the multi oil furnace.

Referring now to the schematic electrical wiring diagram of FIG. 5, several of the safeguards incorporated into the operation of the multi oil furnace 10 can be seen. The control mechanism 60 operatively interconnects several switches and sensors to control the operation of the furnace 10. For example, if the flow of compressed air is interrupted through the air flow path 50, as sensed by the air sensing switch or the de-energizing of the air solenoid shut-off valve 56, the oil solenoid shut-off valve 46 is immediately de-energized to stop the flow of used oil through the oil flow path 40 to the burner nozzle 21.

A proving switch 64 is mounted on the preheater block 30 and will not allow the furnace 10 to operate unless the preheater block 30 has been warmed to the predetermined temperature by the heating element 33. A CAD cell 68 is operable to detect the existence of a flame within the burner chamber 15. The control mechanism 60 will automatically de-energize the air and oil solenoid shut-off valves 46, 56 if a flame in the burner chamber 15 is not detected immediately after heat is called for by the wall thermostat 66.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a multi oil furnace having a burner chamber; means for supplying a flow of used oil; means for supplying a flow of compressed air; a preheater block coupled to said means for supplying used oil to preheat the flow of used oil to a predetermined temperature; a burner assembly coupled with said preheater block and said means for supplying a flow of compressed air for atomizing, igniting and burning used oil supplied thereto, said burner assembly including a burner nozzle operable to combine the flow of used oil and the flow of compressed air to inject a stream of compressed air and atomized used oil droplets into said burner chamber, said burner assembly further including an igniter means for igniting said stream of compressed air and atomized used oil droplets to create a flame in said burner chamber; and means for supplying combustion air to said burner chamber for efficient burning of said stream of compressed air and atomized used oil droplets, said means for supplying combustion air including a fan operable to blow air into said burner chamber and a fan motor operably connected to said fan for rotation thereof, the improvement comprising:

a compartmentalized housing surrounding said burner assembly, said preheater block and said means for supplying combustion air and defining:

a first housing compartment surrounding said preheater block and having openings therein for the input and discharge of a flow of used oil and of a flow of compressed air to and from said preheater block;

a second housing compartment surrounding said fan and said burner assembly and having an air inlet opening through which said fan can draw combustion air and a discharge opening for the discharge of combustion air into said burner chamber, said second housing compartment having a curved peripheral surface to direct the flow of combustion air over said burner assembly before being discharged into said burner chamber; and a third housing compartment surrounding said fan motor adjacent to said first and second housing compartments.

2. The multi oil furnace of claim 1 wherein said burner assembly is cantilevered from said preheater block by two connector lines supplying, respectively, preheated used oil and compressed air to said burner nozzle.

3. The multi oil furnace of claim 2 wherein said igniter means is mounted directly to said burner nozzle to minimize turbulences in the flow of combustion air over said burner assembly.

4. The multi oil furnace of claim 3 wherein said curved peripheral surface of said second housing compartment directs combustion air into a flow stream extending generally tangentially from said curved peripheral surface, said burner assembly having a longitudinal axis oriented parallel to said combustion air flow stream and being positioned within said combustion air flow stream to minimize air turbulences within said flow stream.

5. The multi oil furnace of claim 4 wherein said preheater block has operative controls for the flows of used oil and compressed air integrated into said preheater block, said first housing compartment has a removable cover to permit access to said preheater block and said operative controls.

6. The multi oil furnace of claim 5 wherein said second housing compartment is also provided with a removable cover to permit access to said burner assembly.

7. The multi oil furnace of claim 6 wherein a means for supplying electrical current to said igniter means is mounted on the removable cover of said second housing compartment so that the opening of the removable cover to gain access to said burner assembly operatively disconnects the electrical current to said igniter means.

8. The multi oil furnace of claim 7 wherein said second housing compartment further includes an adjustment means covering said air inlet opening for varying the effective size of said air inlet opening to control the volume of combustion air discharged into said burner chamber.

9. The multi oil furnace of claim 7 wherein the removable covers for the first and second compartments are hinged to the housing.

10. A multi oil furnace comprising:

a cabinet;

a burner chamber supported within the interior of said cabinet;

a housing mounted on the exterior of said cabinet and defining first, second and third housing compartments;

means for supplying a flow of used oil into said first housing compartment;

means for supplying a flow of compressed air into said first housing compartment;

a preheater block supported within said first housing compartment and being coupled to said means for supplying used oil and said means for supplying a flow of compressed air to preheat the flow of used oil and the flow of compressed air to a predetermined temperature;

a burner assembly cantilevered from said preheater block and positioned within said second housing compartment to receive said preheated flows of used oil and compressed air from said preheater block, said burner assembly including a burner nozzle operable to combine the flow of used oil and the flow of compressed air to effect an atomization of said used oil and inject a stream of compressed air and atomized used oil droplets into said burner chamber and an electrical igniter for igniting said stream of compressed air and atomized used oil droplets to create a flame in said burner chamber;

a combustion air fan rotatably mounted in said second housing compartment to supply a flow of combustion air through said second housing compartment to said burner chamber, said second housing compartment having an air inlet opening through which said fan can draw combustion air, a discharge opening for the discharge of combustion air into said burner chamber and a curved peripheral surface to direct the flow of combustion air over said burner assembly before being directed through said discharge opening into said burner chamber; and a fan motor supported in said third housing compartment and being operably connected to said combustion air fan to power the rotation thereof.

11. The multi oil furnace of claim 10 wherein each of said housing compartments have a removable cover to permit access, respectively, to said preheater block, said fan motor and said burner assembly.

12. The multi oil furnace of claim 11 wherein a means for supplying electrical current to said igniter means is mounted on the removable cover of said second housing compartment so that the opening of the removable cover to gain access to said burner assembly operatively disconnects the electrical current to said igniter.

13. The multi oil furnace of claim 12 wherein said curved peripheral surface of said second housing compartment directs combustion air into a flow stream extending generally linearly into said burner chamber, said burner assembly having a longitudinal axis oriented parallel to and within said combustion air flow stream to minimize air turbulences within said flow stream, said igniter being mounted directly to said burner nozzle to minimize the profile perpendicular to said combustion air flow stream, thereby minimizing turbulences in the flow of combustion air over said burner assembly.

14. The multi oil furnace of claim 13 wherein said second housing compartment further includes an adjustment means covering said air inlet opening for varying the effective size of said air inlet opening and, thereby, control the volume of combustion air discharged into said burner chamber.

15. The multi oil furnace of claim 14 wherein gauges indicating respective operative characteristics of said multi oil furnace are mounted on the exterior of said housing.

16. The multi oil furnace of claim 12 wherein the removable covers for the first and second compartments are hinged to the housing.

* * * * *